US005403236A

United States Patent [19]

Greig

[11] Patent Number: 5,403,236

[45] Date of Patent: Apr. 4, 1995

[54] ID CARD FOR PRINTERS HELD BY REPOSITIONAL ADHESIVE

[75] Inventor: Walter G. Greig, Lewiston, N.Y.

[73] Assignee: Moore Business Forms, Inc., Grand Island, N.Y.

[21] Appl. No.: 26,021

[22] Filed: Mar. 4, 1993

[51] Int. Cl.[6] ..... B42D 15/00

[52] U.S. Cl. ..... 462/6; 462/900; 283/74; 283/75

[58] Field of Search ..... 462/6, 64, 65, 25, 900; 283/75, 74, 67, 70, 85, 86, 107–109, 110, 61

[56] References Cited

U.S. PATENT DOCUMENTS

| | | | |
|---|---|---|---|
| 3,068,140 | 12/1962 | Biddle | 156/227 |
| 3,697,101 | 10/1972 | Loos et al. | 283/62 |
| 4,544,590 | 10/1985 | Egan | 428/40 |
| 4,854,610 | 8/1989 | Kwiatek | 282/11.5 A |
| 4,890,862 | 1/1990 | Buchholz | 283/62 |
| 4,982,894 | 1/1991 | Schmidt | 229/69 |
| 4,983,438 | 1/1991 | Jameson . | |
| 5,058,926 | 10/1991 | Drower | 283/109 |
| 5,096,229 | 3/1992 | Carlson | 283/75 |
| 5,129,682 | 7/2992 | Ashby . | |
| 5,131,686 | 7/1992 | Carlson | 283/75 |

FOREIGN PATENT DOCUMENTS 0327754 8/1989 European Pat. Off. .

*Primary Examiner*—Willmon Fridie

*Attorney, Agent, or Firm*—Nixon & Vanderhye

[57] ABSTRACT

A business form has a self-contained ID card which is mounted in such a way that the form has uniform thickness and can readily pass through an impact or non-impact printer, and indicia can be applied to both the top and bottom faces of the ID card by the printer. A first sheet has a first cutout and a first thickness, and an ID card of the same shape and slightly less dimensions, and about the same thickness, is disposed within the cutout. The card is held in the cutout by a backing overlapping at least part of the first cutout bottom face with readily releasable adhesive disposed on the top face of the backing overlapping the cutout and engaging the bottom of the card. The backing may be first and second parallel pieces of tape, or it may be second sheet with a second die cut out in substantial alignment with the first cut out but having lesser dimensions.

23 Claims, 3 Drawing Sheets

Fig. 3
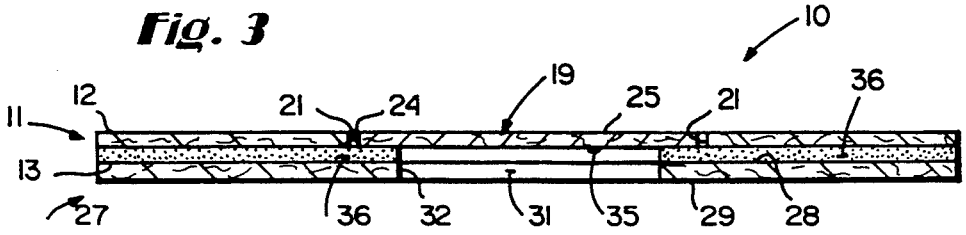
Fig. 4
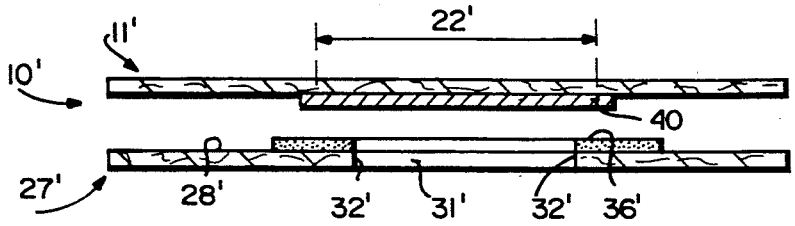
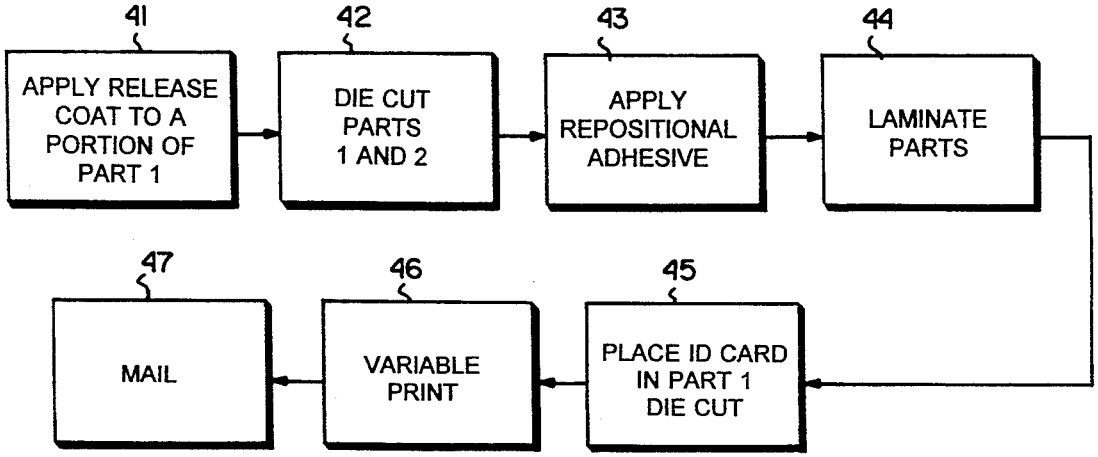
Fig. 5

ID CARD FOR PRINTERS HELD BY REPOSITIONAL ADHESIVE

BACKGROUND AND SUMMARY OF THE INVENTION

There are many uses for ID cards, and it is becoming increasingly popular in the manufacture of business forms to mount one or more ID cards on a form that is mailed to a recipient. While significant amounts of preprinted, non-variable, data may be provided on the ID card and mounting form, it is also highly desirable to provide at least some variable data on the ID card and/or surrounding form.

In the construction of forms of the general type as described above, it is highly desirable to be able to use the form with both impact and non-impact printers with minimum amount of difficulties, and to be able to print the ID card with variable information on both the top and bottom faces thereof.

According to the present invention a business form, and method of production thereof, are provided which have the desirable attributes described above. In particular the business form according to the present invention has substantially uniform thickness throughout, allowing it to pass easily through impact and non-impact printers without hangups. Also, because of the uniform thickness the business form according to the invention reduces or eliminates uneven pads which develop in conventional ID carrier business forms where a card is directly affixed to (on top of) the surface of the carrier. Also, the construction and method according to the invention allow duplex printing (that is both the top and bottom faces) of the card with variable information by the output printer.

According to one aspect of the present invention a business form is provided comprising the following elements: A first sheet having top and bottom faces. Means defining a first cutout in the first sheet having a substantially quadrate configuration with first length and width dimensions, and a first thickness. A card having a substantially quadrate configuration with given second length and width dimensions, both slightly less than the first length and width dimensions, and having a thickness substantially the same as the first thickness. The card disposed in the first cutout and having top and bottom faces. A backing overlapping at least part of the first cutout on the bottom face of the first sheet, the backing having a top face facing the cutout, and a bottom face facing away from the cutout. And, readily releasable adhesive, which will readily release the card, disposed on the top face of the backing overlapping the cutout, so that the card is held in the cutout by the readily releasable adhesive with the card top face substantially flush with the first sheet top face.

The backing for the business form according to the invention may take one of two main configurations. One configuration is to provide the backing as first and second pieces of tape having adhesive disposed on substantially the entire top face thereof, overlapping different portions of the cutout. In particular, it is desirable to provide the first and second pieces of tape substantially parallel to each other along the length dimension of the first cutout, and for the backing to consist of the first and second pieces of tape.

An alternate construction of the backing for the business form according to the invention provides the backing as a second sheet having a second cutout therein in substantial alignment with the first cutout. The second cutout has third length and width dimensions at least one of which is significantly less than the first dimensions, so as to provide a portion of the second sheet overlapping the first sheet at the cutout with the readily releasable adhesive disposed on the overlapping portion of the second sheet. Preferably both the third length and width dimensions are less than the first dimensions so that the overlapping portion of the second sheet comprises a generally quadrate frame. The adhesive may hold the first and second sheets laminated together along the majority of the bottom and top faces thereof, respectively.

The card preferably comprises an ID card of paper or plastic, while the first sheet is typically paper, and the ID card has indicia imaged on at least the top face thereof, preferably also the bottom face.

According to another aspect of the present invention a method of producing a business form from a first sheet and backing, each having top and bottom faces, is provided. The method comprises the following steps: (a) Making a first quadrate die cut opening in the first sheet, having first length and width dimensions. (b) Applying repositional adhesive to the top face of at least a portion of the backing. (c) Providing the backing in juxtaposition to the first sheet so that a portion of the backing having repositional adhesive overlaps the bottom face of the first sheet at the first die cut opening. And (d) inserting a quadrate card having top and bottom faces, and second length and width dimensions slightly less than the first length and width dimensions, in the first quadrate die cut opening, so that the card is held in the opening by the repositional adhesive.

In the practice of the method where the backing is a second sheet, there is a further step of forming a second die cut opening in the second sheet having third length and width dimensions, at least one of which is less than the first length and width dimensions; in which case step (c) is practiced by substantially aligning the centers of the first and second die cut openings. Alternatively, where the backing comprises first and second strips of tape, step (c) is practiced by placing the first and second strips of tape (typically parallel to each other) into contact with the bottom face of the first sheet so that portions of the top face of the tape pieces overlap different edges of the first die cut opening.

The card, which has substantially the same thickness as the first sheet, so that the top face of the card is flush with the top face of the sheet, and form may be fed in either continuous or cut sheet form through an impact or nonimpact printer, and both the top and bottom faces of the card may be imaged, the bottom face being imaged through a void area in the backing.

It is a primary object of the present invention to provide a simple yet effective business form bearing an ID card or the like. This and other objects of the invention will become clear from an inspection of the detailed description of the invention and from the appended claims.

BRIEF DESCRIPTION OF THE DRAWINGS

FIG. 3 is a cross-sectional view of the form of FIG. 1 taken along lines 3—3 thereof;

FIG. 4 is an exploded cross-sectional view of a second modification of the exemplary form of FIGS. 1 through 3;

FIG. 5 is a schematic box diagram showing exemplary method steps that may be used in the production of the form of FIGS. 1 through 3.

DETAILED DESCRIPTION OF THE DRAWINGS

Figure 1:
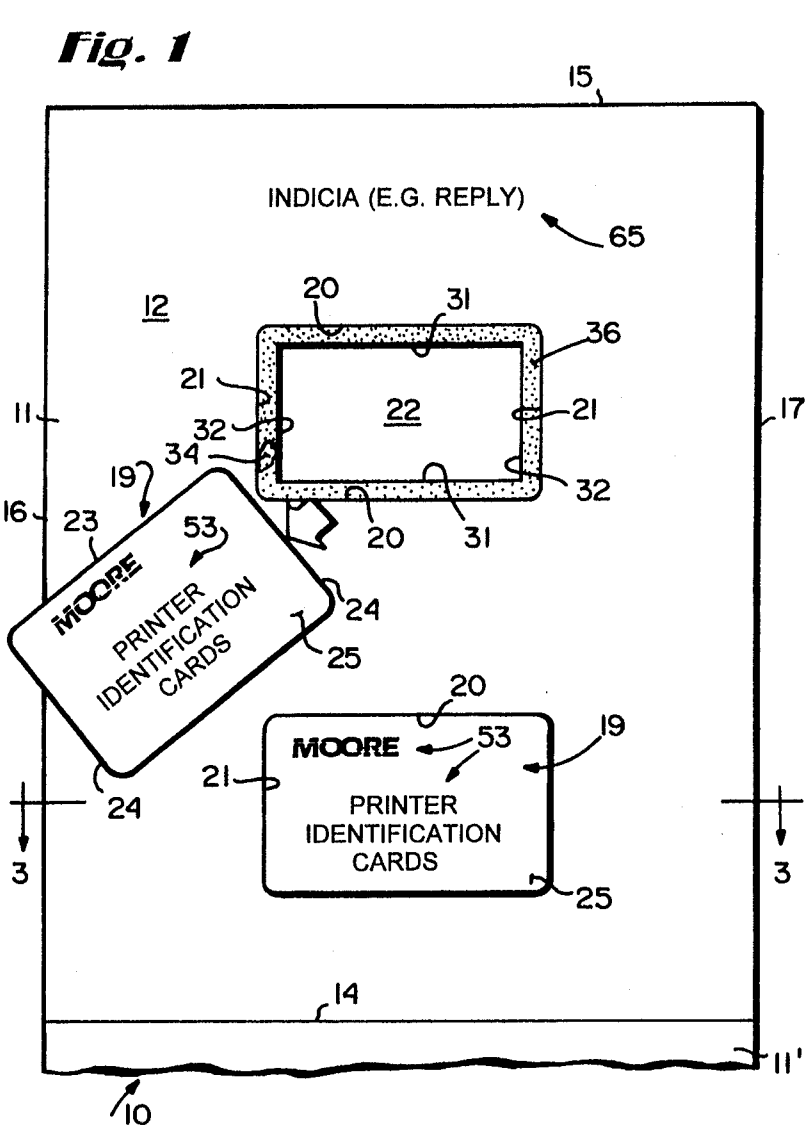
FIG. 1 is a top plan view of the first exemplary embodiment of a business form according to the present invention, with one of two ID cards associated with the form being shown as detached for clarity of illustration.

FIG. 1 illustrates an exemplary form according to the present invention by reference numeral 10. The business form 10 comprises a first sheet 11 having a top face 12 and a bottom face 13 (see FIG. 3), which may be in sheet form, or may be in continuous form. The continuous form is schematically illustrated by an attached sheet construction of substantially the same configuration shown by reference numeral 11′ in FIG. 1, the individual sheets being connected by a perforation line 14 or the like.

Note that the sheet 11 is substantially quadrate in configuration having a leading edge 15 and a trailing edge 14, and side edges 16, 17. The sheet 11 preferably is made out of paper, and has a first thickness.

According to the present invention at least one card (in FIGS. 1 and 2 two cards are illustrated) 19 forms part of the business form 10. The card 19, which may be of paper, plastic, or other synthetic material, is adapted to be mounted within a die cutout defined by the length edges 20 and the width edges 21 in FIG. 1, so that an open area 22 is provided therebetween. The card 19 has length 23 and width 24 dimensions which are slightly less than the dimensions 20, 21, and the card 19 preferably has substantially the same thickness as the sheet 11 so that it can nest in the cutout 22 with the top face 25 of the card 19 flush with the top face 12 of the sheet 11.

The form 10 also comprises a backing overlapping at least part of the cutout 22 on the bottom face 13 of the first sheet 11. In the embodiment illustrated in FIGS. 1 through 3, the backing comprises a second sheet 27 (see FIGS. 2 and 3) having a top face 28 (see FIG. 3) and a bottom face 29. The sheet 27 has substantially the same configuration and dimensions as the first sheet 11, and the faces 13, 28 thereof are parallel to and immediately adjacent each other, typically being laminated to each other.

Figure 2:
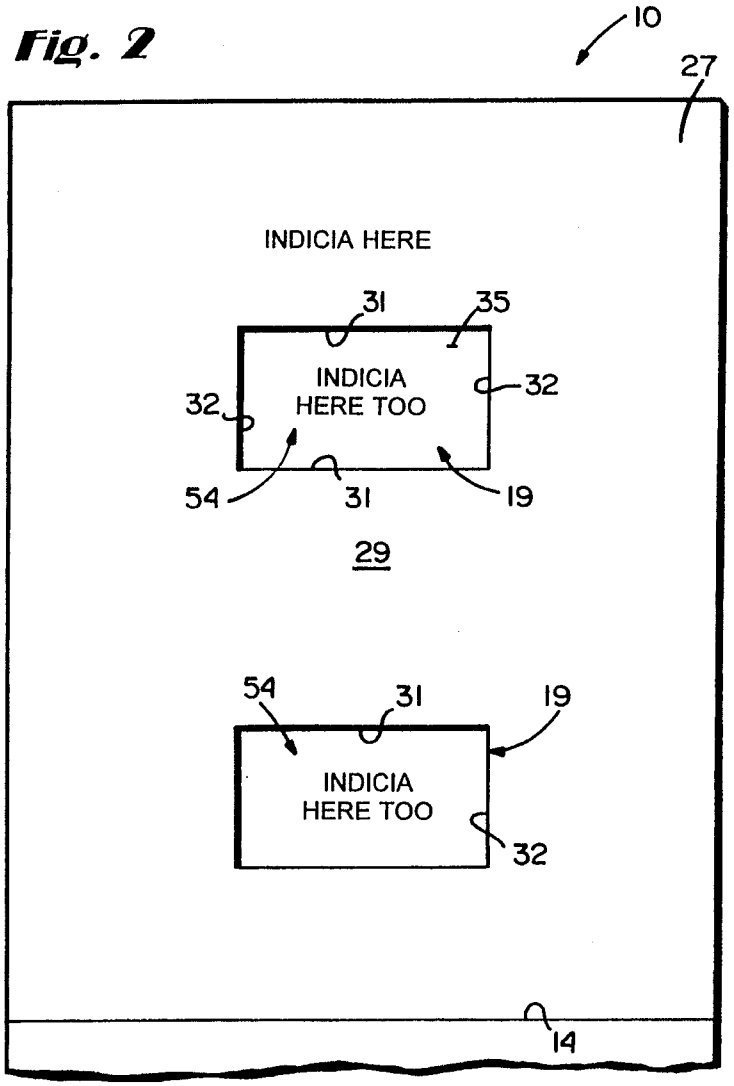
FIG. 2 is a bottom plan view of the form of FIG. 1 with both cards in place.

The second sheet 27 has a second die cutout formed therein, also having a rectangular configuration, the lengthwise edges of the die cut being shown by reference numerals 31 in FIG. 2, while the widthwise edges of the cutout are shown by reference numerals 32. The die cutout formed by the edges 31, 32 is essentially in alignment with the cutout 22 (i.e., they are substantially concentric) so that the cutout 22 at the top of FIG. 1 illustrates both the first and second cutouts on the first 11 and second 27 sheet sheets, respectively.

As seen in FIG. 1, the second cutout is smaller than the first cutout along at least one dimension, and preferably along all four sides so that a frame configuration 34 is provided on which the bottom face 35 of the ID card 19 rests. In order to properly hold the ID card in place, readily releasable adhesive (e.g., repositional adhesive such a sold by Moore Business Forms, Inc. of Lake Forest, Ill. under the trademark Cleantac TM) 36 is disposed on the top face 28 of the second sheet 27 at at least the frame 34. The adhesive 36 will readily release the card 19, only holding it in place with enough force so that it can be readily passed through a printer, and mailed or otherwise delivered to a recipient. When the card 19 is removed from contact with the adhesive 36, no significant adhesive residue will remain thereon.

FIG. 3 illustrates the construction of FIGS. 1 and 2 in cross section. In this particular embodiment the adhesive 36 is disposed over a majority of the top face 28 of the second sheet 27 and laminates the sheets 11, 27 together in addition to releasably holding the card 19 in place. However, if desired, the adhesive 36 need only be provided where it will be engaging the card, and the sheets may be held together in other ways, as by permanent adhesive, static forces, deformations of the substrates forming the sheets, etc. Also, it may be necessary to provide a release coating on the bottom face 13 of the sheet 11 at the area where the die cut 22 will be formed so as to not remove the adhesive 36 from the frame portion 34 when the cutout area of the sheet 11 is removed. Such an embodiment is illustrated schematically in FIG. 4.

In FIG. 4 all the components comparable to those in FIGS. 1 through 3 are shown by the same reference numeral only followed by a "′". In FIG. 4, the sheet 11′ of business form 10′ has a silicone or other release coating 40 spot applied to the portion thereof where the die cut 22′ is to be formed. In this embodiment also, the adhesive 36′ is not formed over the entire top face 28′ of the second sheet 27′, but rather only at the area immediately adjacent the cutout edges 31′32′. After the sheets 11′, 27′ of the FIG. 4 embodiment are moved together, the first sheet 11′ is die cut, and the silicone coating 40 allows the cutout portion at 22′ to be readily removed without removing the adhesive 36′ with it.

Figure 6:
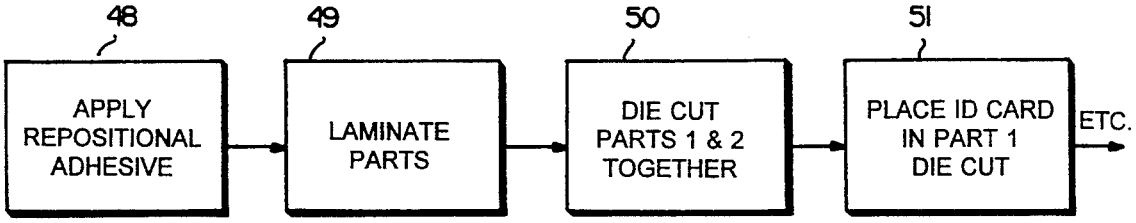
FIG. 6 is an alternative method schematic.

There are a number of different ways in which the business form 10, 10′ described above may be constructed. Two exemplary manners are illustrated in FIGS. 5 and 6. FIG. 5 relates to the FIG. 4 construction, while FIG. 6 primarily relates to the FIGS. 1 through 3 construction, although the various order of the steps may be changed.

In the FIG. 5 embodiment, a release coat (such as the coat 40) is applied to the bottom face of the first sheet as indicated by box 41, then both parts (both sheets) are die cut as illustrated at 42. The repositional adhesive 36, 36′ is provided in either spot or full face coating, either press applied, applied by a finishing machine, or by a coater, as indicated schematically at 43, and then the parts are laminated together as indicated at 44. The ID card 19 is then placed in the cutout 22, 22′ as illustrated at 45. Then the entire form 10, 10′ is passed, either in sheet form or in continuous form, through a printer—as indicated at stage 46—where variable indicia is imaged or printed on just the top face 25, or both the top face and bottom face 25, 35, of the ID card 19, and then the business form 10, 10′ is mailed as indicated by box 47.

In the embodiment of FIG. 6, the particular steps and their order are slightly different. In the FIG. 6 embodiment first the repositional adhesive is applied as indicated at box 48, and then the parts of the form are laminated together as indicated at 49. Then both parts 1 and 2 are die cut at the same time as indicted by box 50, and then the ID card is placed in the part 1 die cutout 22 as indicated at box 51 in FIG. 6. Then the variable printing and mailing steps are the same as indicated in FIG. 5.

FIGS. 1 and 2 also show the printing that is applied at stage 46. The printing applied to the top face 25 may be as illustrated at 53 in FIG. 1, while the duplex (backside) printing is illustrated at 54 in FIG. 2.

Figure 7:
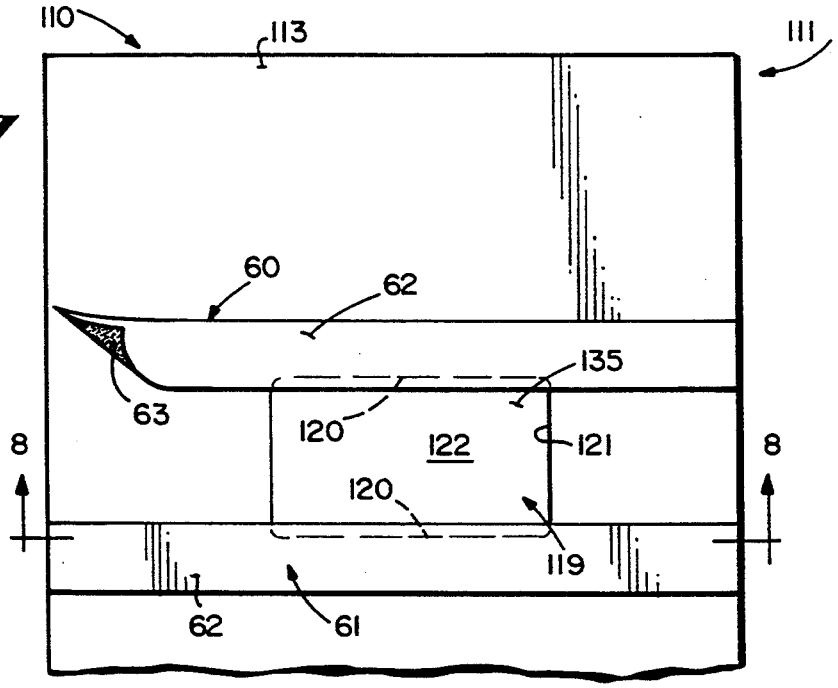
FIG. 7 is a bottom plan view of a part of a second embodiment of business form according to the invention.
Figure 8:
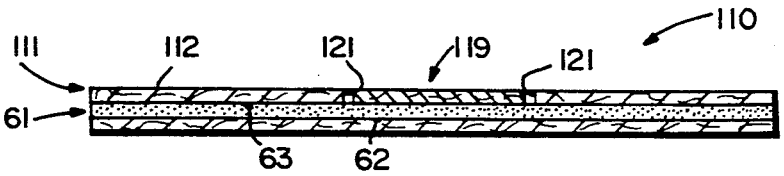
FIG. 8 is a cross-sectional view taken along lines 8—8 of FIG. 7.

FIGS. 7 and 8 illustrate a second embodiment according to the present invention. In the second embodiment the construction of the backing is different. In the embodiment of FIGS. 7 and 8, a release coat like the release coat 40 illustrated in FIG. 4 is not necessary, since only one sheet needs to be die cut. Also, because of the particular construction of the backing the costs for paper adhesive may be substantially reduced and also the areas on the face of the coupon, or the like, since they do not have the double thickness.

In the FIGS. 7 and 8 embodiment components comparable to those in the FIGS. 1 through 3 embodiment are shown by the same reference numeral only preceded by a "1".

In the construction of FIGS. 7 and 8, the backing comprises first and second pieces (strips) of tape illustrated schematically at reference numerals 60, 61 in FIG. 7, only the strip 61 being seen in FIG. 8. Each strip 60, 61 comprises a substrate 62 with readily releasable (e.g., repositional) adhesive 63 on the bottom face thereof. The strips 60, 61 are applied so that they overlap both longitudinal edges 120 (and a small part of the transverse edges 121) of the cutout 122 formed in the first sheet 111, so that the adhesive 63 thereon will engage the bottom face 135 of the card 119 and hold it in place. The adhesive 63 also holds the substrate 62 of the pieces of tape 60, 61 to other portions of the bottom face 113 of the first sheet 111.

While the form 110 of FIGS. 7 and 8 does have some nonuniformity of thickness, it is not substantial enough —because of the relatively thin nature of the strips of tape 60, 61—to significantly adversely affect printing, and because of the small size of the strips 60, 61 compared to the FIGS. 1 through 3 embodiment, the cost can be significantly less. Also, indicia like the indicia 65 illustrated in FIG. 1, if provided on the top face 112 of the first sheet 111, can form a reply element, commercial coupon, or the like, and perforations or other like lines of weakness (not shown) can be formed in the sheet 111 to facilitate detachment of a portion thereof with the indicia (e.g., 65) thereon. The form 110 of FIGS. 7 and 8 is used in the same manner as the form 10, e.g., being passed through a variable printer, etc.

It will thus be seen that according to the present invention an advantageous business form mounting an ID card or the like, and a method of manufacture and utilization thereof, have been provided. While the invention has been herein shown and described in what is presently conceived to be the most practical and preferred embodiment thereof, it will be apparent to those of ordinary skill in the art that many modifications may be made within the scope of the invention, which scope is to be accorded the broadest interpretation of the appended claim so as to encompass all equivalent structures and procedures.

What is claimed is:

1. A business form comprising:

a first sheet having top and bottom faces;

means defining a first cutout, including a recess, in said first sheet having a substantially quadrate configuration with first length and width dimensions, and a first thickness;

a card having a substantially quadrate configuration with given second length and width dimensions, both slightly less than said first length and width dimensions, and having a thickness substantially the same as said first thickness;

said card disposed in said first cutout recess and having top and bottom faces;

a backing overlapping at least part of said first cutout recess on the bottom face of said first sheet, said backing having a top face facing said cutout recess, and a bottom face facing away from said cutout recess; and readily releasable adhesive, which will readily release said card, disposed on said top face of said backing overlapping said cutout recess, so that said card is held in said cutout recess by said readily releasable adhesive with said card top face substantially flush with said first sheet top face.

2. A business form as recited in claim 1 wherein said backing comprises first and second pieces of tape having adhesive disposed on substantially the entire top face thereof, and overlapping different portions of said first cutout.

3. A business form as recited in claim 2 wherein said first and second pieces of tape are substantially parallel to each other.

4. A business form as recited in claim 3 wherein said backing consists of said first and second pieces of tape.

5. A business form as recited in claim 4 wherein said first sheet is paper, and said card is selected from the group consisting essentially of paper and plastic.

6. A business form as recited in claim 1 wherein said backing comprises a second sheet, said second sheet having a second cutout therein in substantial alignment with said first cutout, said second cutout having third length and width dimensions at least one of which is significantly less than said first dimensions, so as to provide a portion of said second sheet overlapping said first sheet at said first cutout; said readily releasable adhesive disposed on said overlapping portion of said second sheet.

7. A business form as recited in claim 6 wherein both said third length and width dimensions are less than said first dimensions, so that said overlapping portion of said second sheet comprises a generally quadrate frame.

8. A business form as recited in claim 6 wherein said adhesive holds said first and second sheets laminated together along the majority of said bottom and top faces thereof, respectively.

9. A business form as recited in claim 1 wherein said card comprises an ID card having indicia imaged on said top face.

10. A business form as recited in claim 9 further comprising indicia printed on said bottom face of said ID card.

11. A business form as recited in claim 1 wherein said first sheet is paper, and said card is selected from the group consisting essentially of paper and plastic.

12. A business form as recited in claim 6 wherein said card comprises an ID card having indicia imaged on said top face.

13. A method of producing a business form from a first sheet and backing, each having top and bottom faces, comprising the steps of:

(a) making a first quadrate cutout through extending opening in the first sheet, having first length and width dimensions;

(b) applying repositional adhesive to the top face of at least a portion of the backing;

(c) providing the backing in juxtaposition to the first sheet so that a portion of the backing having repositional adhesive overlaps the bottom face of the first sheet at the first cutout through extending opening; and (d) inserting a quadrate card having top and bottom face, and second length and width dimensions slightly less than the first length and width dimensions, in the first quadrate cutout through extending opening, so that the card is held in the opening by the repositional adhesive.

14. A method as recited in claim 13 wherein the backing is a second sheet, and comprising the further step of forming a second cutout opening in the second sheet having third length and width dimensions at least one of which is less than the first length and width dimensions; and wherein step (c) is practiced by substantially aligning the centers of the first and second cutout openings.

15. A method as recited in claim 14 wherein the card has approximately the same thickness as the first sheet; and wherein step (d) is practiced so as to position the card so that a top face thereof is substantially flush with the top face of the first sheet.

16. A method as recited in claim 15 comprising the further step of passing the business form through a printer to effect printing of the top face of the card.

17. A method as recited in claim 16 wherein said printing step is also practiced to print the bottom face of the card at the second die cut opening.

18. A method as recited in claim 13 wherein the backing comprises first and second strips of tape; and wherein step (c) is practiced by placing the first and second strips of tape into contact with the bottom face of the first sheet so that portions of the top face of the tape pieces overlap different edges of the first die cut opening.

19. A method as recited in claim 18 wherein step (c) is practiced by placing the first and second strips of tape parallel to each other.

20. A method as recited in claim 13 wherein the card has approximately the same thickness as the first sheet; and wherein step (d) is practiced so as to position the card so that a top face thereof is substantially flush with the top face of the first sheet.

21. A method as recited in claim 20 comprising the further step of passing the business form through a printer to effect printing of the top face of the card.

22. A business form comprising:

a first sheet having top and bottom faces;

means defining a first cutout in said first sheet having a substantially quadrate configuration with first length and width dimensions, and a first thickness;

a card having a substantially quadrate configuration with given second length and width dimensions, both slightly less than said first length and width dimensions, and having a thickness substantially the same as said first thickness;

said card disposed in said first cutout and having top and bottom faces;

a backing overlapping at least part of said first cutout on the bottom face of said first sheet, said backing having a top face facing said cutout, and a bottom face facing away from said cutout;

readily releasable adhesive, which will readily release said card, disposed on said top face of said backing overlapping said cutout, so that said card is held in said cutout by said readily releasable adhesive with said card top face substantially flush with said first sheet top face; and wherein said backing comprises first and second pieces of tape having adhesive disposed on substantially the entire top face thereof, and overlapping different portions of said first cutout.

23. A method of producing a business form from a first sheet and a second sheet comprising backing, each having top and bottom faces, comprising the steps of:

(a) making a first quadrate die cut opening in the first sheet, having first length and width dimensions;

(b) applying repositional adhesive to the top face of at least a portion of the backing;

(c) providing the backing in juxtaposition to the first sheet so that a portion of the backing having repositional adhesive overlaps the bottom face of the first sheet at the first die cut opening;

(d) inserting a quadrate card having top and bottom face, and second length and width dimensions slightly less than the first length and width dimensions, in the first quadrate die cut opening, so that the card is held in the opening by the repositional adhesive;

(e) forming a second die cut opening in the second sheet having third length and width dimensions at least one of which is less than the first length and width dimensions; and wherein the step (c) is practiced by substantially aligning the centers of the first and second die cut openings.

* * * * *